US007561066B2

(12) United States Patent
Ashton

(10) Patent No.: US 7,561,066 B2
(45) Date of Patent: Jul. 14, 2009

(54) RAILROAD WAYSIDE SIGNAL SYSTEM

(75) Inventor: Michael L. Ashton, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 474 days.

(21) Appl. No.: 11/272,336

(22) Filed: Nov. 10, 2005

(65) Prior Publication Data

US 2007/0102592 A1 May 10, 2007

(51) Int. Cl.
*G08G 1/095* (2006.01)

(52) U.S. Cl. ..... 340/907; 246/473.3; 362/428

(58) Field of Classification Search ..... 340/907; 246/473.3; 362/428
See application file for complete search history.

(56) References Cited

U.S. PATENT DOCUMENTS 4,616,225 A * 10/1986 Woudenberg ..... 340/908
5,171,088 A 12/1992 Tellier et al.
5,743,635 A * 4/1998 Hulse et al. ..... 362/385
5,791,604 A * 8/1998 Nielsen et al. ..... 246/473.3
6,435,459 B1 8/2002 Sanderson et al.
7,062,221 B1 * 6/2006 Christensen ..... 455/3.01
7,349,025 B2 * 3/2008 Wong ..... 348/373
2002/0105432 A1 * 8/2002 Pederson et al. ..... 340/815.45
2003/0095411 A1 * 5/2003 Blackwelder ..... 362/385
2005/0162544 A1 * 7/2005 Wong ..... 348/373
2005/0241885 A1 * 11/2005 Burgess et al. ..... 187/297
2006/0267796 A1 * 11/2006 Oskroba et al. ..... 340/908

* cited by examiner

*Primary Examiner*—Jeffery Hofsass
(74) *Attorney, Agent, or Firm*—Robert Wawrzyn, Esq.; Robert L. Wolter, Esq.; Beusse Wolter Sanks Mora & Maire, P.A.

(57) ABSTRACT

This invention is a railroad wayside signal system positioned adjacent to a railroad track that comprises a mast that is attached to a support structure in an upright position. A signal head having one or more signal lights is mounted to the mast such that a locomotive operator in an approaching locomotive can see the signal lights. The mast pivots with respect to the support structure between the upright position and a substantially horizontal position for maintaining and/or aligning the signal head and signal lights. The signal system may also be equipped with one or more actuators operatively connected to the signal head. A remote control unit is placed in communication with the actuators, and the remote control has an input mechanism for inputting a command representative of a direction of rotation of the signal head. The remote control also generates a signal in response to the input command that is representative of one or more directions of rotation.

35 Claims, 11 Drawing Sheets

RAILROAD WAYSIDE SIGNAL SYSTEM

BACKGROUND OF THE INVENTION

The present invention relates in general to railroad wayside signal systems. More specifically, the present invention pertains to the maintenance of such systems and the alignment of signal lights incorporated in such systems.

Wayside signal systems are used to control the speed and position of a locomotive on a railroad track relative to other locomotives on the track. These systems typically consist of a mast that is mounted to a support structure that is positioned adjacent to a railroad track. A signal head is mounted to the mast, and one or more signal lights are mounted on the signal head so a locomotive operative in an approaching locomotive can see the signal lights.

Some of the support structures of the signal systems may take the form of a bridge or cantilevered arm extending over the railroad track. These support structures include ladders and catwalks so signal maintainers may reach the signaling systems for maintaining and manually aligning the signal head and signal lights. The signaling systems are mounted on such a structure above the track with the signal lights in view of locomotive operators. Alternatively, the signal head may be mounted directly to the support structure above the railroad track and may not require a mast.

Other signaling systems include a support structure, such as a large concrete block or steel frame buried in the ground beside the railroad track. A base of the mast is mounted to the support structure and extends vertically in an upright position. The signal head is mounted on the mast at about twelve feet to nineteen feet above the ground so a locomotive operator can see the signal lights. In addition, such systems may also be equipped with a platform and ladder so that a signal maintainer can reach the signal lights and signal head for purposes of manually aligning the signal lights and/or providing maintenance to the signal head and signal lights.

In either case, the signal system utilizes a mounting system that enables the signal head to rotate or pivot on two axes, in order to obtain a proper alignment of the signal lights with respect to an approaching locomotive. These mounting systems include one or more bolts and nuts on the bolts, which are manually rotated on the bolt to tilt the signal head on one or both of the axes. Two signal maintainers are necessary to achieve the proper alignment of the signal lights with respect to an on-coming locomotive. A first signal maintainer is positioned on the ground adjacent to the railroad track a predetermined distance from the mast. A second signal operator is positioned on a platform, catwalk or ladder on the support structure. The second signal maintainer manually adjusts the position of the signal head and signal lights according to instructions from the first signal maintainer on the ground.

These present signaling systems expose the signal maintainers to injury because the signal maintainers must climb up to nineteen feet above the ground, and in some instances over the railroad track to align or maintain the signal lights. In addition, ladders and platforms installed on such systems increase the cost of production and installation of the signaling systems.

SUMMARY OF THE INVENTION

The present invention is a railroad wayside signal system positioned adjacent to a railroad track that comprises a mast that is attached to a support structure in an upright position. A signal head having one or more signal lights is mounted to the mast such that a locomotive operator in an approaching locomotive can see the signal lights.

The mast pivots with respect to the support structure between the upright position and a substantially horizontal position for maintaining and/or aligning the signal head and signal lights. The term substantially horizontal as used in this disclosure shall mean any position, other than the mast upright position, to which the mast is pivoted so the signal head and signal lights can be reached by a signal maintainer on the ground.

The signal system may also be equipped with one or more actuators operatively connected to the signal head. A remote control unit is placed in communication with the actuators, and the remote control has an input mechanism for inputting a command representative of a direction of rotation of the signal head. The remote control also generates a signal in response to the input command that is representative of one or more directions of rotation. The remote control operation can be used on wayside signals positioned on the ground beside a railroad track, or those wayside signals that are mounted to a support structure above the railroad track.

BRIEF DESCRIPTION OF THE DRAWINGS

FIG. 10 is an expanded perspective view of the gear assembly connected to the signal head of the wayside signal system.

DETAILED DESCRIPTION OF THE DRAWINGS

Figure 1:
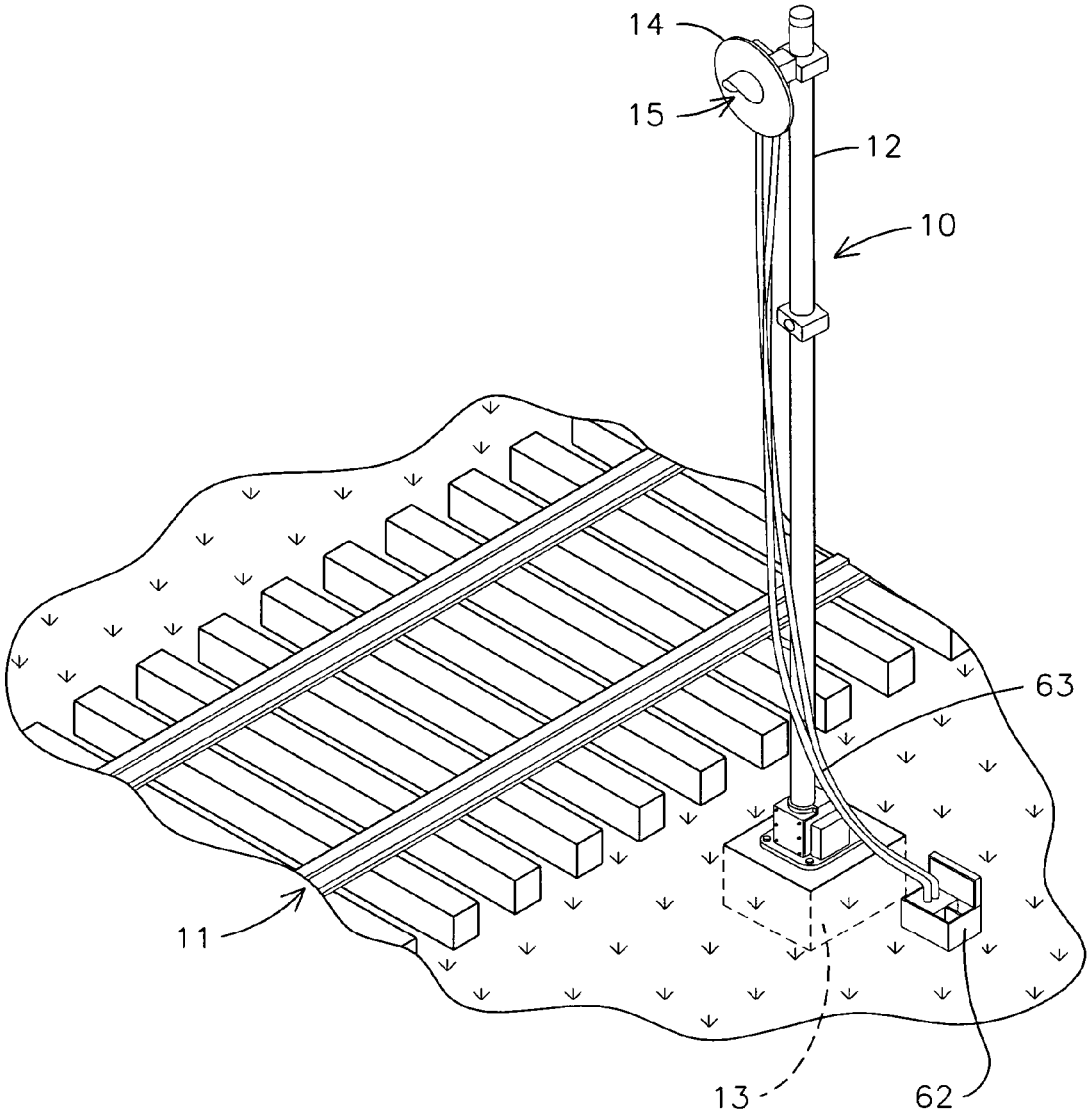
FIG. 1 is a perspective view of a wayside signal system.
Figure 2:
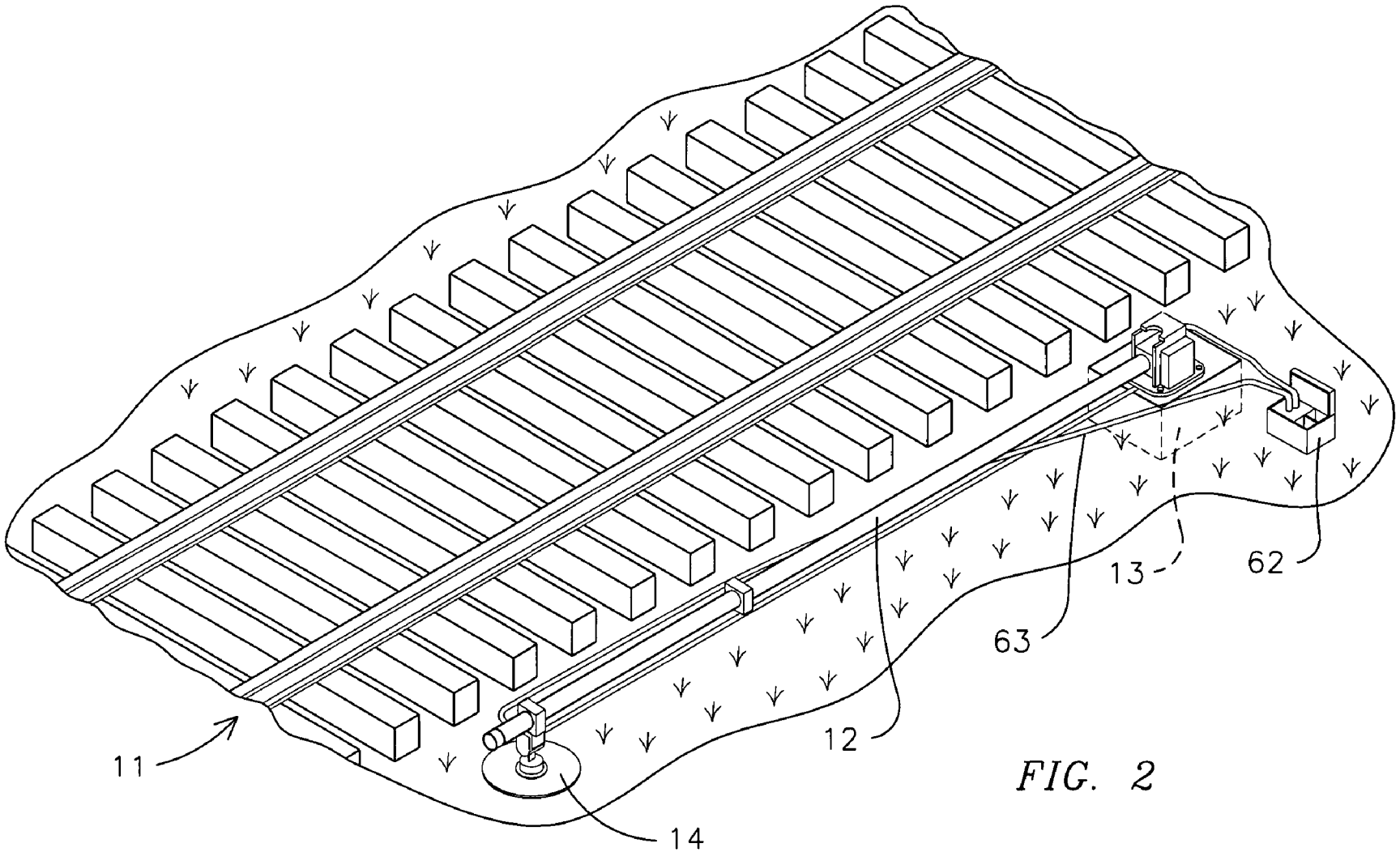
FIG. 2 is a perspective view of the mast of the wayside signal system pivoted in its down position.

An embodiment of the wayside signal system 10 is depicted in FIGS. 1 and 2 adjacent a railroad track 11. The wayside signal system 10 comprises a mast 12 mounted to a support structure 13 in a vertical upright position. A signal head 14 having one or more signal lights 15 is affixed on the mast 12 at a height such that an operator of an approaching locomotive can see the signal lights 15. As will be explained in more detail below the signal head 14 is pivotally mounted to the mast 12 such that the signal head 14 pivots on at least two axes for aligning the signal lights 15 with respect to an approaching locomotive.

The support structure 13, as shown in FIG. 1, is typically at least partially buried in the ground and may take the form of a large concrete block or steel frame, or a similar such structure that is known to those skilled in the art. As shown in FIG. 2, the mast 12 is pivotally mounted to the support structure 13, such that the mast 12 can be lowered to a substantially horizontal position, so signal maintainers can maintain the signal head 14 and signal lights 15 from the ground.

A mechanism for pivotally mounting the mast 12 to the support structure 13 is illustrated in FIGS. 3 through 9, and comprises a gear assembly 50 operatively connected to a mounting block 22. The gear assembly 50 and mounting block 22 are supported in a housing 16, which is secured to the support structure 13. The mast 12 is secured to the mounting block 22, and a clamp 17 affixed to a side of the housing 16 supports the mast 12 in an upright position. The gear assembly 50 and mounting block 22 are supported in the housing 16 in such a manner to allow the mounting block 22 to pivot when the gear assembly 50 is actuated. The clamp 17 is removed before the gear assembly 50 is actuated in order to lower the mast 12.

Figure 3:
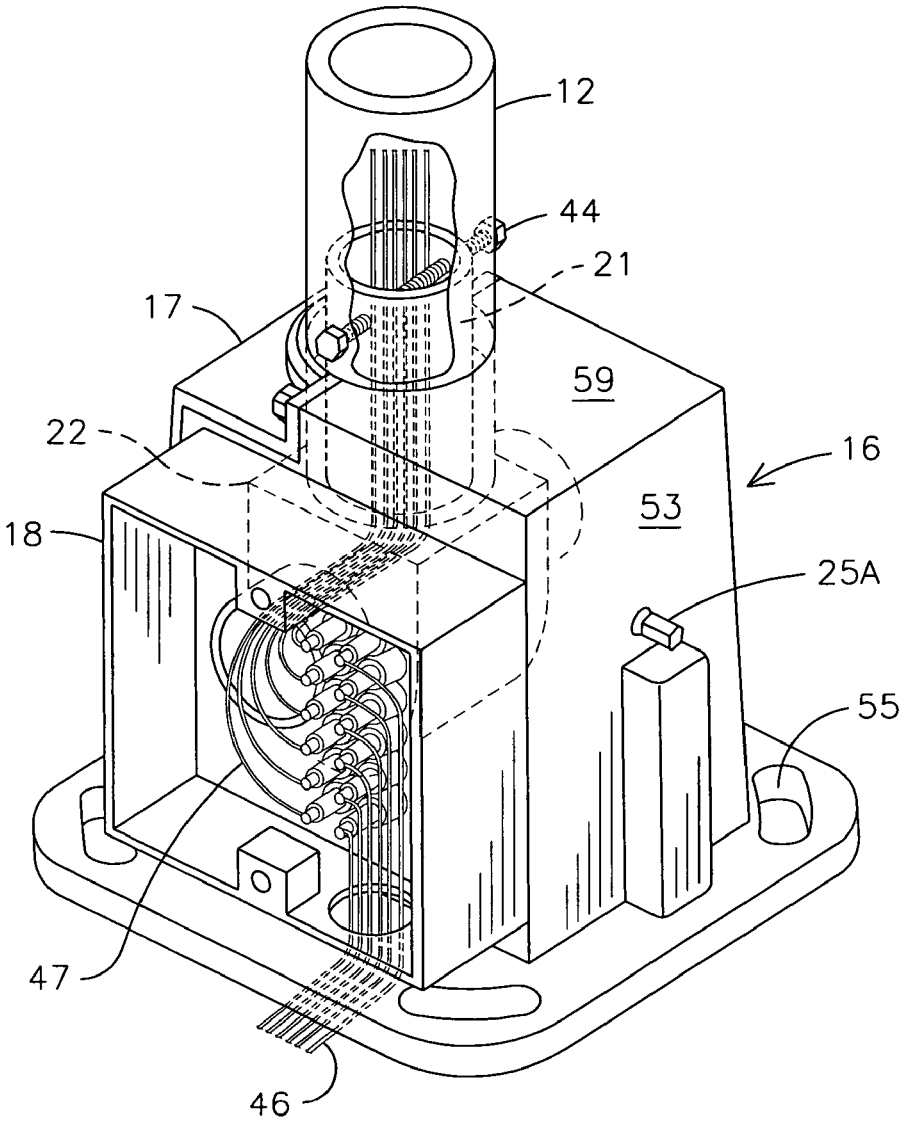
FIG. 3 is a perspective view of the housing supporting the gear assembly of the wayside signal system.
Figure 4:
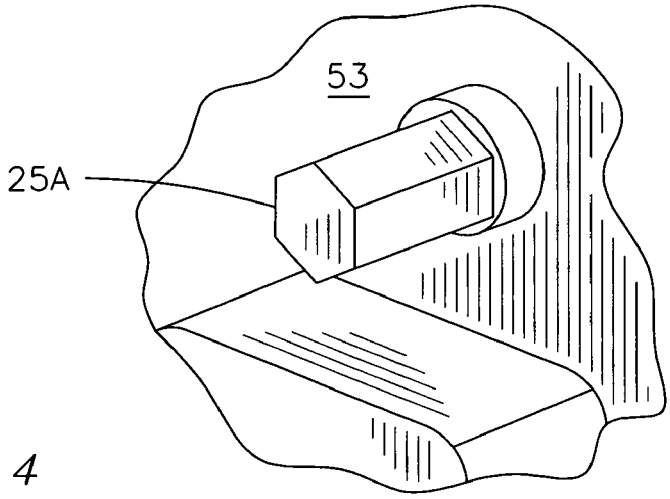
FIG. 4 is a perspective view of the end of a worm gear
Figure 5:
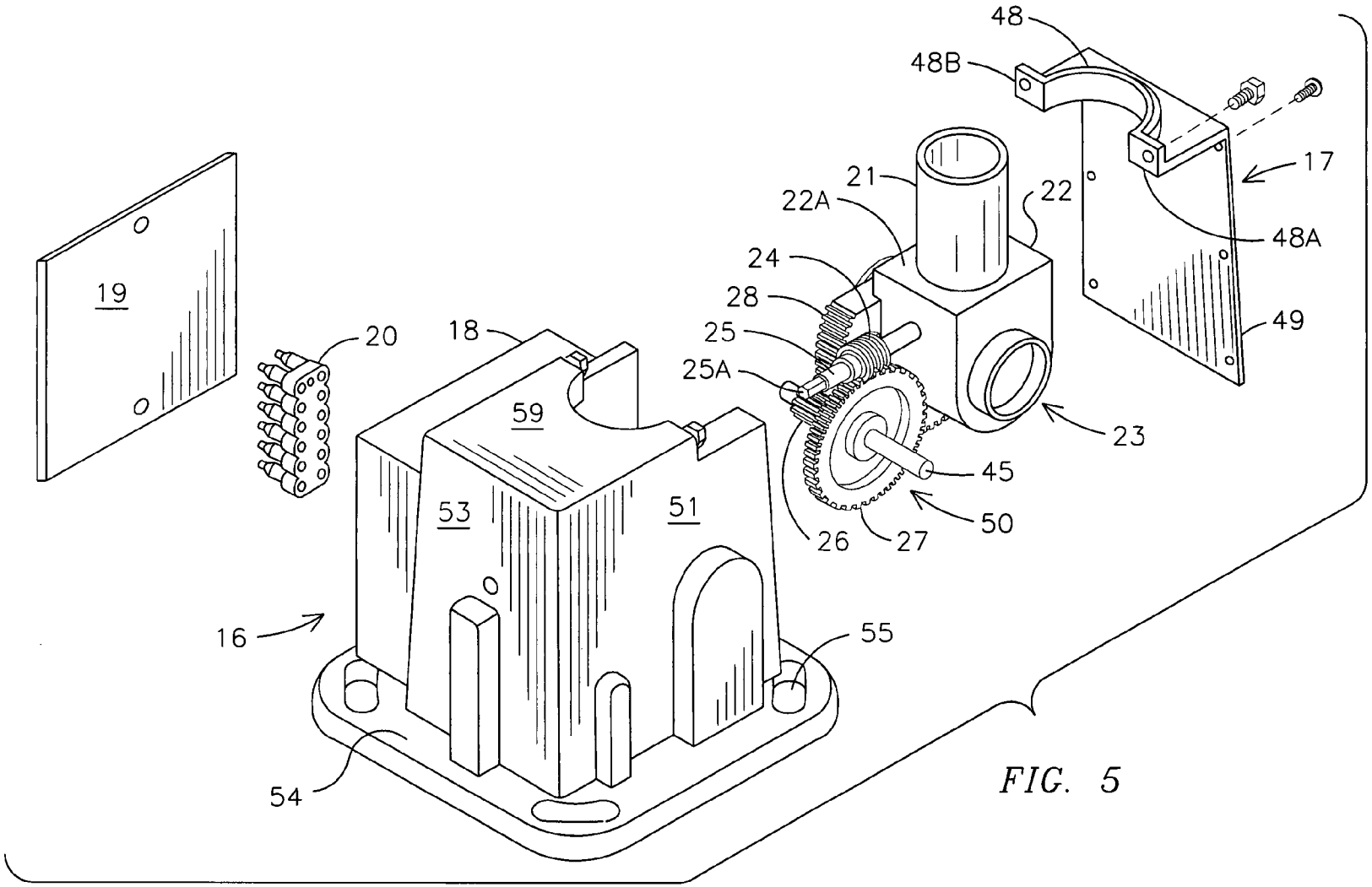
FIG. 5 is an expanded view of the housing and gear assembly for the wayside signal system.
Figure 8:
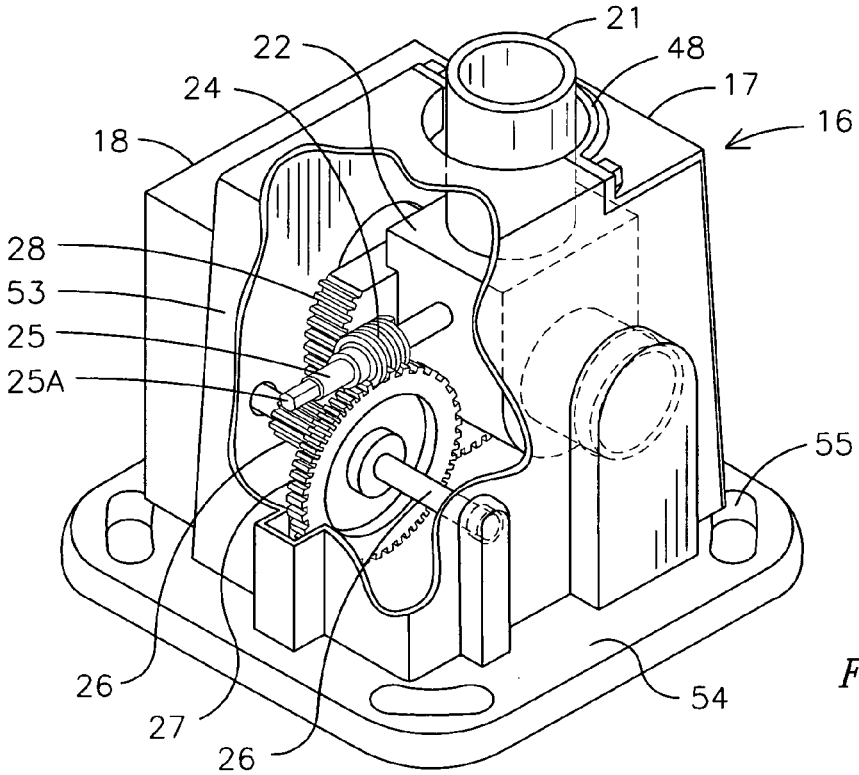
FIG. 8 is a perspective view of the housing with a section removed to illustrate gear assembly within the housing.

With respect to FIGS. 3, 5 and 8, the housing 16 has three side panels 51, 52 and 53 affixed to a base 54. The base 54 preferably has one or more holes 55 through which bolts or other anchoring mechanisms may be inserted for mounting the housing 16 to the support structure 13. A top panel 59 is affixed to a top of the side panels 51, 52 and 53 to partially cover an interior of the housing 16 and the gear assembly 50. The side panels 51 and 52 have an L-shaped top segment forming a lip 56, having a horizontal portion 56A and vertical portion 56B on each side panel 51 and 52. Vertical flanges 58 extend along the side panels 51 and 52 from the horizontal portions 56A to the base 54 of the housing 16. The entire housing 16 is preferably fabricated from a cast aluminum material using molds so the panels 51, 52 and 53 are integrally affixed to the top panel 59 and base 54.

Figure 9:
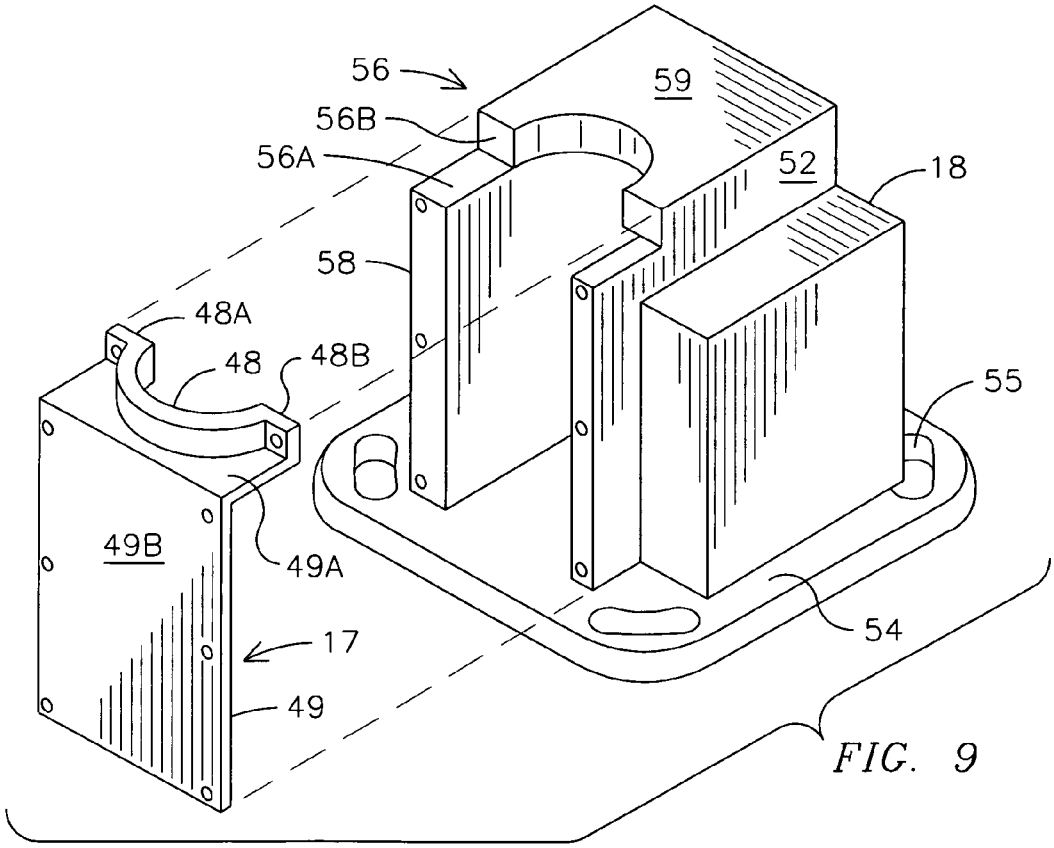
FIG. 9 is a rear perspective view of the housing for the gear assembly operatively connected to the mast.

As shown in FIGS. 5 and 9, the clamp 17 includes a collar 48 integrally formed with a panel 49. The collar 48 has flanges 48A and 48B that abut, and are affixed to the respective vertical portions 56B of the lip 56 on side panels 51 and 52. The panel 49 has a horizontal section 49A that rests on the horizontal portion 56A of lip 56, and vertical section 49B that is secured to flanges 58 on the side panels 51 and 52. The collar 48 and top panel 59 of the housing 16 have semicircular configurations. Accordingly, securing the clamp 17 to the housing forms an opening through which the mast 12 extends. In this manner, the clamp 17 and housing 16 cover the gear assembly 50 protecting the gear assembly 50 from debris and other foreign materials, and support mast 12 in an upright position.

The attachment of the mast 12 to the mounting block 22 is shown in more detail in FIGS. 3, 5 and 8. A mounting stub 21 is affixed to a top 22A of the mounting block 22 and is a tubular fixture. The mounting block 22 and mounting stub 21 are preferably fabricated as a single unit. The mast 12 fits over the mounting stub 21 and the bottom 12A of the mast abuts a top 22A of the mounting block 22. The mast 12 has an inside diameter slightly larger than an outside of the mounting stub 21 so the mast 12 fits over mounting stub 21. The differences in diameter may range depending on the piping used and may be about 0.032 of an inch. The mast 12 may be secured to the mounting stub 21 using cross bolts 44, or other fasteners or clamping devices known to those skilled in the art. Alternatively, the mast 12 and mounting block 22 could be fabricated as a single unit.

The height of the mounting stub 21 depends on various factors including, but not limited to, the height of the mast 12, the position of the signal head 14 on the mast 12, the surface area and weight of the mast 12 and signal head 14 and wind tolerances. For example, the height of the mounting stub 21 may range from about six inches to about 2 feet or more.

With respect to FIGS. 5 and 8, a tubular axle 23 extends through the mounting block 22 below the mounting stub 21 having ends 23A and 23B that are supported on the housing 16 such that the tubular axle 23 may rotate. A circular indent (not shown) is formed in side panel 51 and supports end 23A of the tubular axle. The end 23B of the tubular axle 23 is supported in an aperture formed in side panel 52.

Power is supplied to the signal head 14 and signal lights 15 via a first set of electrical cables 46 connected to a power source, and a second set of electrical cables 47 operatively connected to the signal lights 15 that reside within the mast 12. The power source may include a nearby control house (not shown). A junction box 18 is mounted on side panel 52 of the housing 16, and has electrical terminals 20 to which an end of the electrical cables 46 are attached. A cover 19 is mounted to the junction box 18 to protect the terminals 20 and cables 46.

The tubular axle 23 has an opening (not shown) between the ends 23A and 23B, which opening is aligned with a bottom of the mounting stub 21 so that electrical cables 47 may extend through the tubular axle 23, mounting stub 21 and up through the mast 12 to the signal lights 15. In this manner, power can be supplied to the signal lights 15 for operation.

Figure 6:
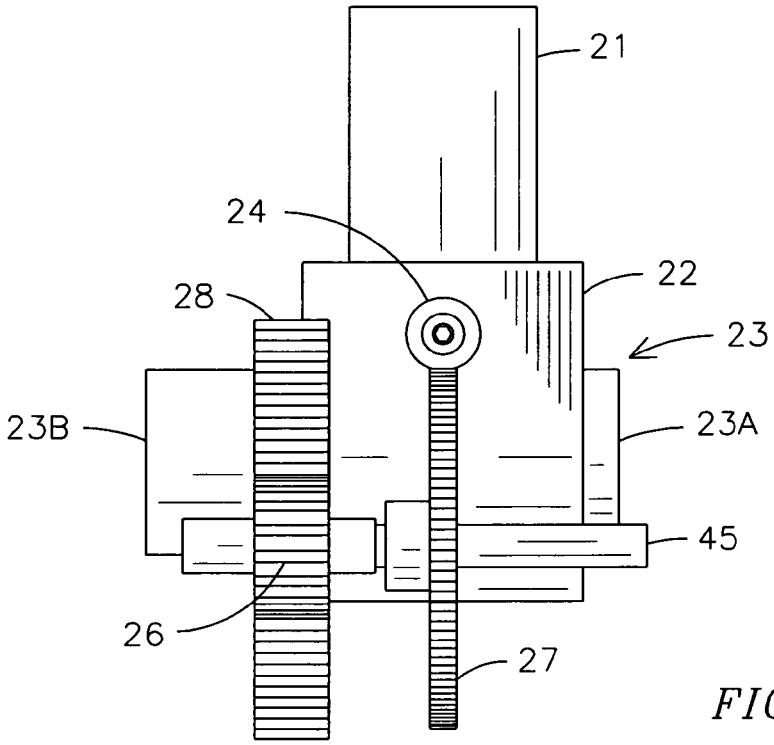
FIG. 6 is front elevational view of the gear assembly of the present invention.
Figure 7:
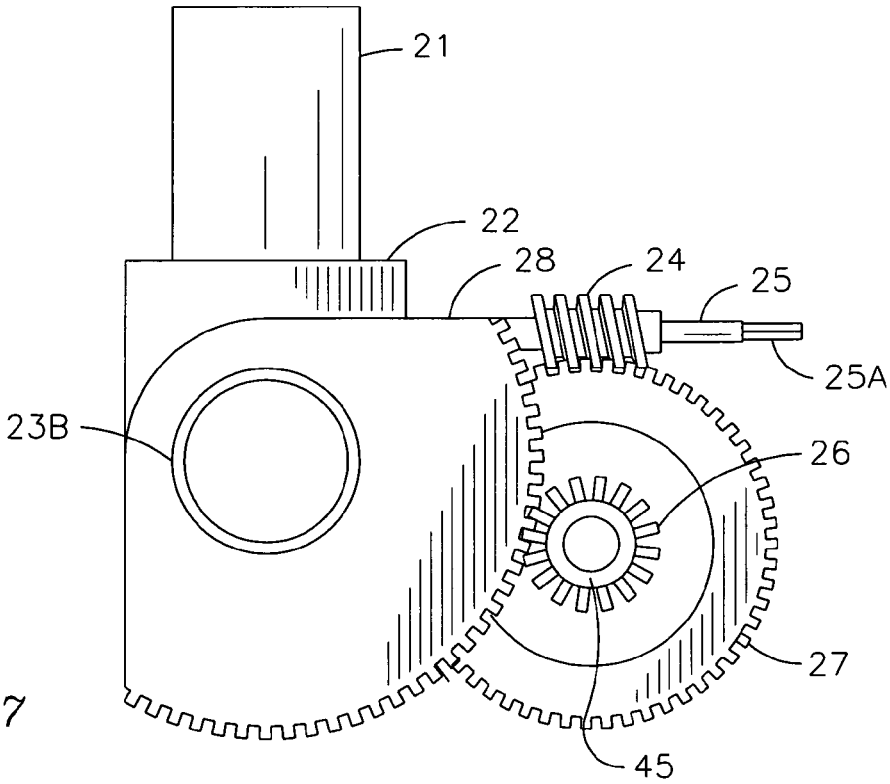
FIG. 7 is side elevational view of the gear assembly of the present invention.

The gear assembly 50 that moves the mounting block 22 and lowers the mast 12 is shown in FIGS. 5, 6 and 7 and comprises a sector gear 28 affixed to a side of the mounting block 22. The sector gear 28 is positioned in mating relationship with a first spur gear 26, which is affixed to an axle 45. In addition, a second spur gear 27 is affixed to the axle 45 adjacent to the first spur gear 26. The axle 45 is supported on indentations formed in the interior surface of panels 51 and 52 of the housing 16. A worm gear 24 is positioned in mating relationship with the second spur gear 27 and has a shaft 25 having an end 25A adapted for receiving a tool to actuate the worm gear 24. By of example, the shaft end 25A of the shaft may have hexagonal configuration for engaging or receiving a wrench head. The shaft end 25A protrudes from the housing 16 through an aperture in panel 53, so a maintainer may actuate the worm gear 24 and gear assembly 50 to lower the mast.

In operation, a signal maintainer removes the clamp 17 in order to lower the mast 12. The signal maintainer, using a tool engages the shaft end 25A of the worm gear 24 and actuates the worm gear 24, which causes the second spur gear 27 to rotate. The rotation of the second spur gear 27 causes the axle 45 and consequently the first spur gear 26 to rotate. The rotation of first spur gear 26 causes the sector gear 28 to rotate, which in turn rotates the mounting block 22, and the mast 12 is lowered. The mast 12 is lowered to a position that enables the signal maintainer to reach the signal head 14 and signal lights 15 for maintenance.

A signal head 14 shown in FIGS. 1 and 2 is mounted to a mast 12 and pivots with respect to the mast 12 along one or more axes for purposes of aligning the signal lights 15 with respect to a locomotive on the track 11. A signal maintainer (not shown) on the ground preferably controls the movement of the signal head 14 remotely. More specifically, actuators 36 and 37 and a gear assembly 29 are operatively connected to the signal head 14 to move the signal head 14. An arm 30 is affixed to a backside of the signal head 14 and to the gear assembly 29. The gear assembly 63 is mounted within a casing 38, which is mounted to the mast 12 using known clamping devices.

Figure 10:
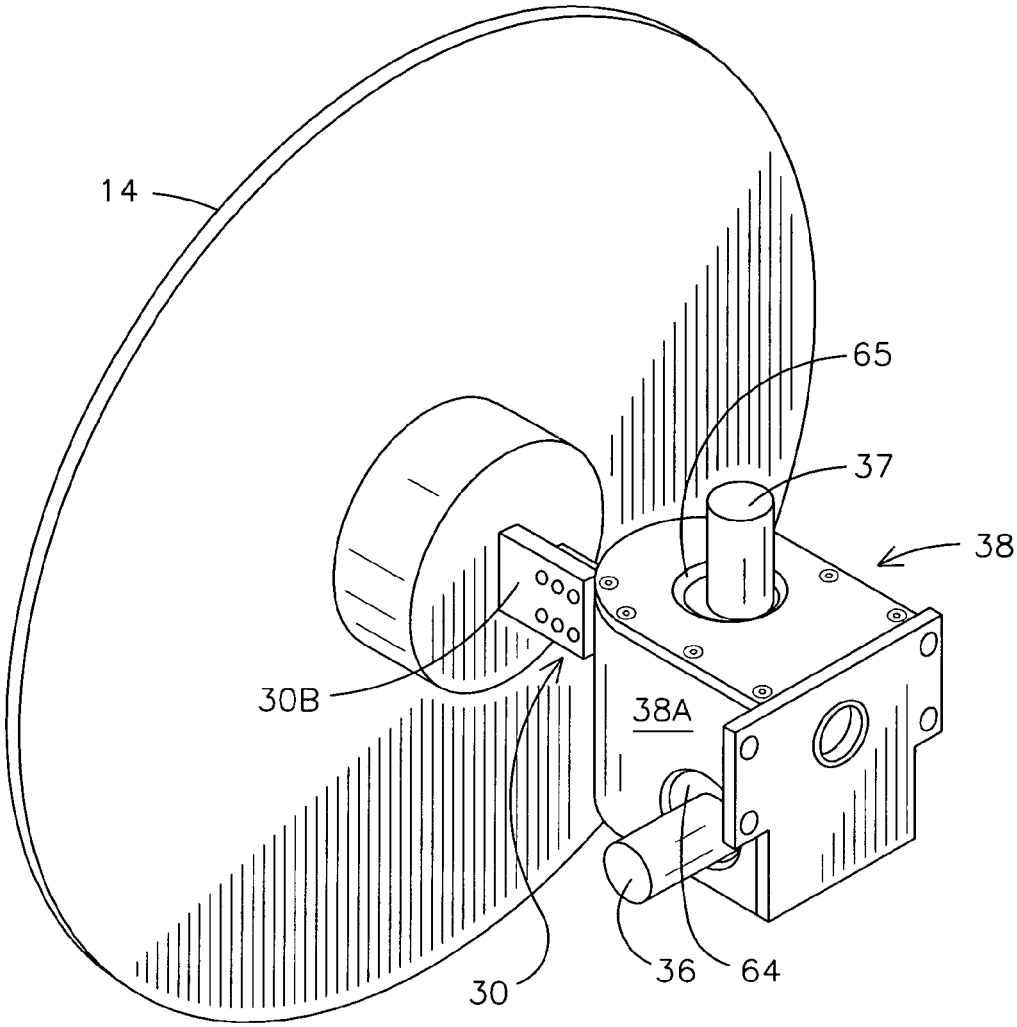
FIG. 10 is a rear perspective view of the signal head and actuators of the wayside signal system.
Figure 11:
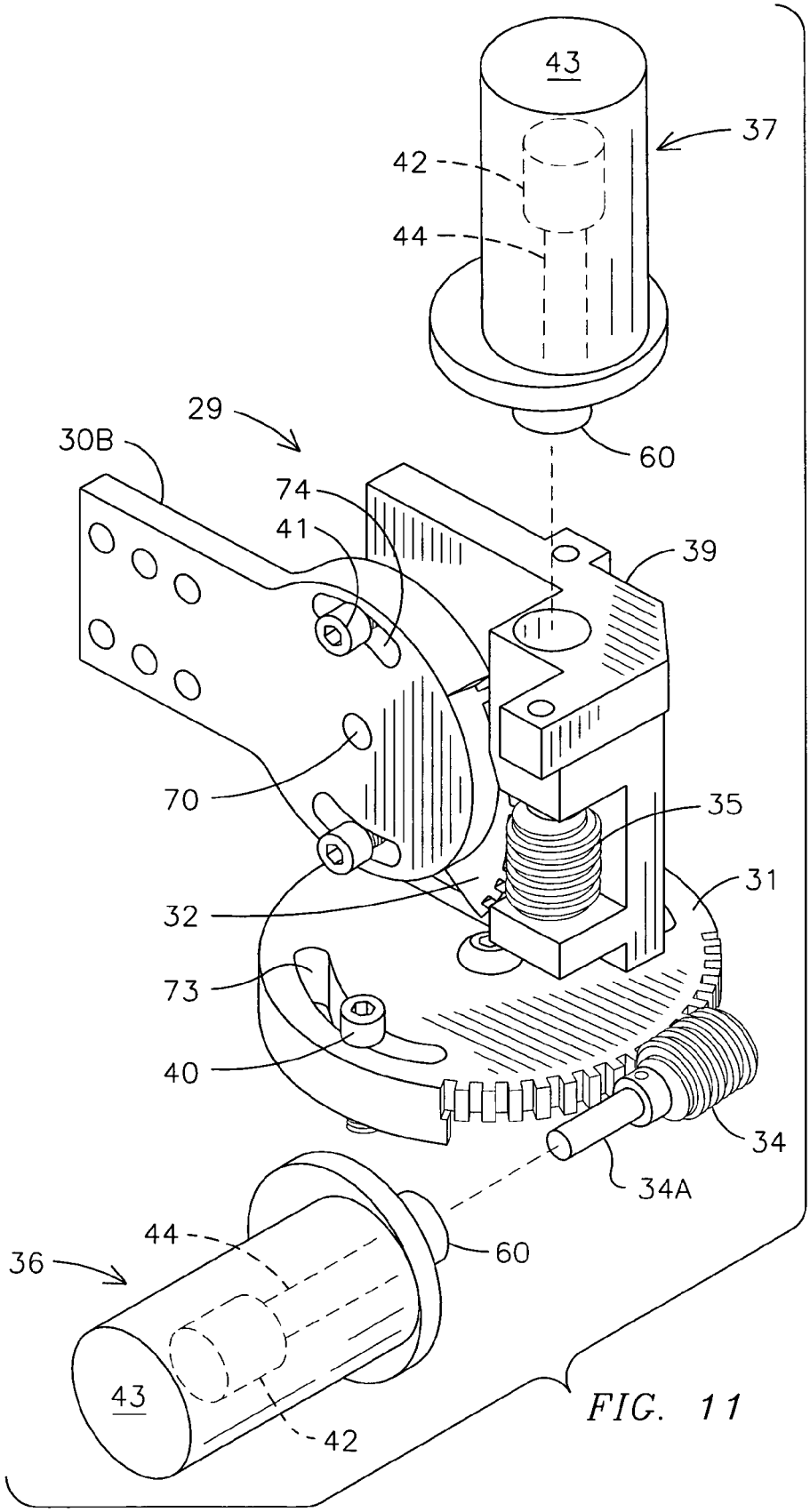
FIG. 11 is an exploded perspective view of the gear assembly for the signal head.
Figure 12:
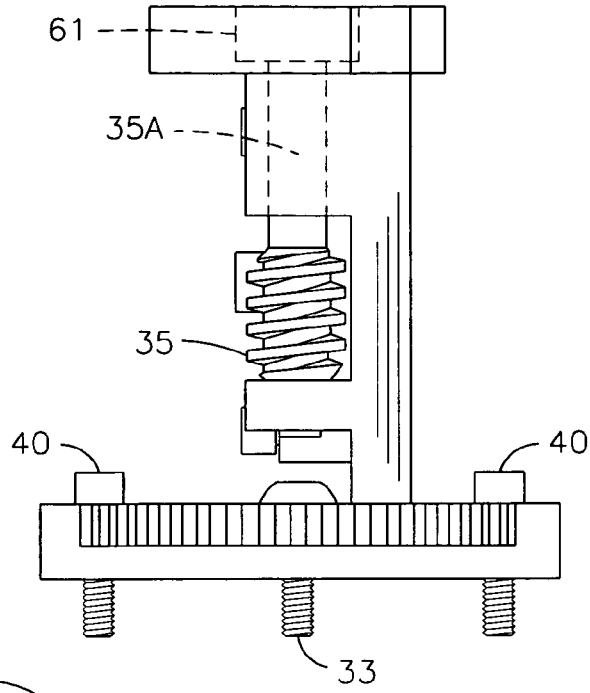
FIG. 12 is a rear elevational view of the gear assembly of the signal head.
Figure 13:
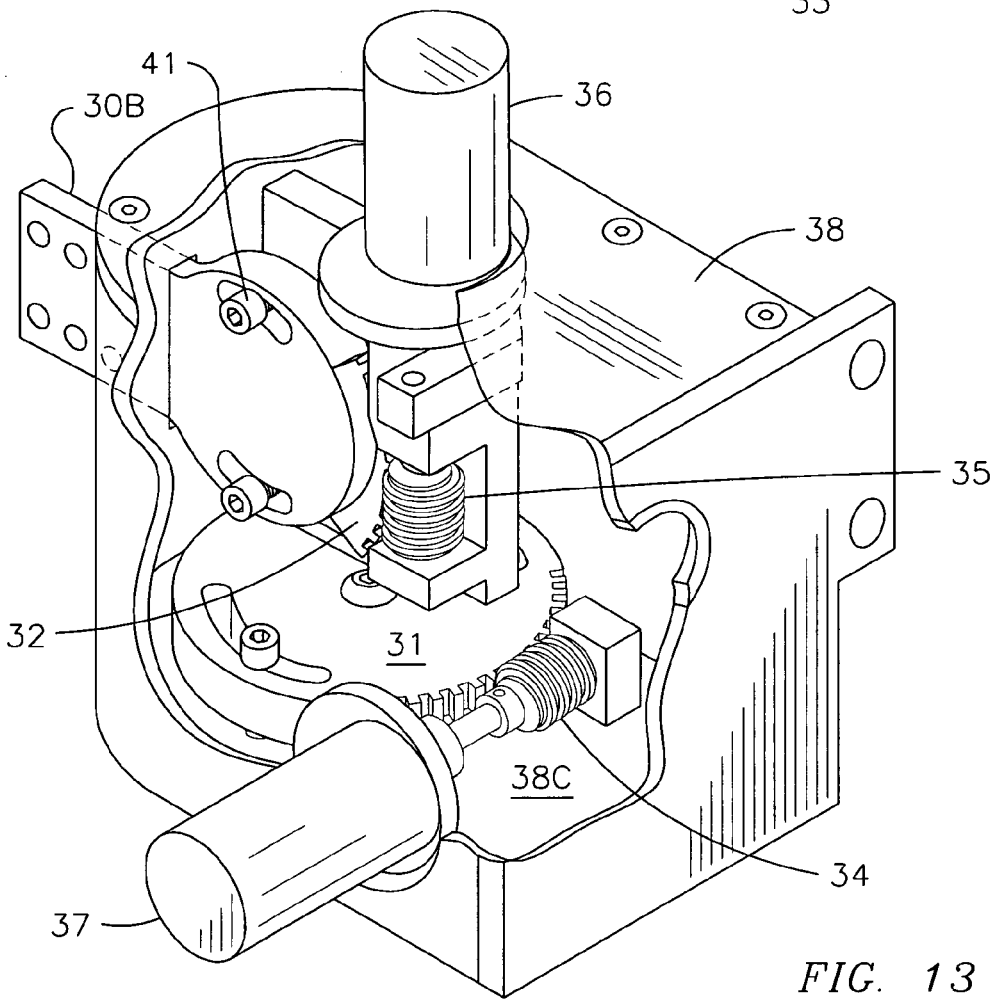
FIG. 13 is perspective view of the gear assembly for the signal head mounted in a housing.

In the exemplary embodiment shown in FIGS. 10, 11 and 13, the actuators 36 and 37 may be dc powered drive motors that actuate the movement of the gears 31 and 32 of the signal head gear assembly 29. A first drive motor 36 controls movement of the signal head 14 along a horizontal axis, and a second drive motor 37 controls movement of the signal head 14 along a vertical axis.

The gear assembly 29 comprises a first worm gear 34 that is mounted within the casing 38 in mating relationship with a horizontally disposed first sector gear 31. A second worm gear 35 is vertically disposed and in mating relationship with a vertically disposed second sector gear 32. The second worm gear 35 and second sector gear 32 are mounted on bracket 39, which is mounted on top of the first sector gear 31. The arm 30 is mounted at one end to the signal head 14 and at the other end to the second sector gear 32, which is mounted to the bracket 39. Thus, movement of the first worm gear 34 causes the rotation of the first sector gear 31 and the bracket 39, which causes the arm 30 and the signal head 14 to pivot horizontally or from side to side.

In an exemplary embodiment illustrated in FIGS. 10, 11 and 13, the arm 30 includes a first extension 30A mounted to a backside of the signal head 14, and a second extension 30B mounted to the second sector gear 32. The first extension 30A and second extension 30B are bolted to one another. In this manner, a signal maintainer can detach the signal head 14 from the gear assembly 29 as needed for maintenance of the signal head 14 or signal lights 15 without disturbing the gear assembly 29 or drive motors 36 and 37.

The first drive motor 36 is operatively connected to a shaft 35A of the first worm gear 34 and rotates the worm gear 34 when activated. The second drive motor 37 is operatively connected to a shaft 35A of the second worm gear 35 and rotates the second worm gear 35 when activated. In the exemplary embodiment illustrated in FIG. 10, the casing 38 has a first aperture 64 in a side panel 38A through which the first drive motor 36 extends and connects to the first worm gear 34. A second aperture 65 is formed in a top panel 38B of the casing 38 through which the second drive motor 37 extends and connects to the second worm gear 35.

The first sector gear 31 is supported in part within the casing by a shoulder bolt 33 inserted through the center of the gear 31 and secured to the bottom panel 38C of the casing 38. The first sector gear 31 rotates on the shoulder bolt 33 when the drive motor 36 is activated. Similarly, the second sector gear 32 is mounted to the bracket 39 with a shoulder bolt 70. The second sector gear 32 rotates on the shoulder bolt 70 when the second drive motor 37 is activated.

Locking pins 40 and 41 are attached to the first sector gear 31 and second sector gear 32 respectively to lock the gear assembly 29 and signal head 14 in place after the signal lights 15 have been aligned. The locking pins 40 on the first sector gear 31 are a bolt inserted through a circumferentially extending slots 73 formed in the first sector gear 31. The bolt or pin has a bottom end inserted in a threaded aperture (not shown) in a bottom panel 38C of the casing 38. The locking pins 41 on the second sector gear 32 are inserted through a circumferentially extending slot 74 formed in the second sector gear 32. The locking pin 41 is inserted in a threaded aperture (not shown) on the bracket 39.

Figure 14:
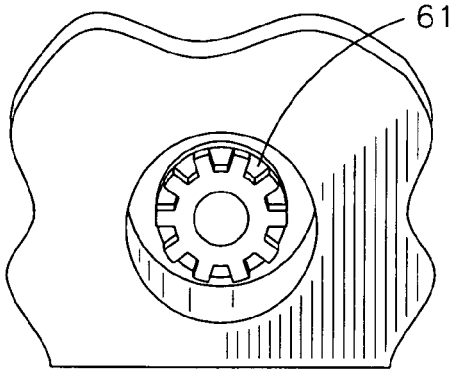
FIG. 14 is a perspective view of the head and spline of the shaft on a worm gear.
Figure 15:
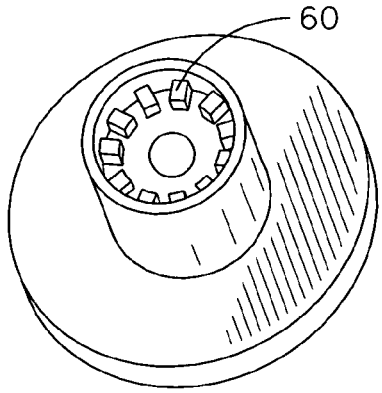
FIG. 15 is a perspective view of the spline on a drive motor for actuating the gear assembly for moving the signal head.

In an exemplary embodiment, the drive motors 36 and 37 are detachable from the gear assembly 29. Each drive motor 36 and 37 comprises a dc motor or ac motor 42 mounted within a housing 43, and a shaft 44 and operatively connected to the motor 42 that rotates when the motor 42 is activated. A first spline 60, shown in FIG. 15, is mounted at the end of each of the motor shafts 44 distal the motor. A second spline 61, shown in FIG. 14, is mounted on the shaft 34A and 35A of each of the worm gears 34 and 35. The second splines 61 on the worm gear shafts 34A and 35A are placed in mating relationship with the first splines 60 on the end of the drive motor shafts 44. In this manner, the drive motors 36 and 37, when activated, will actuate the respective worm gears 34 and 35, and move the signal head 14. In addition, the drive motors 36 and 37 are detachable from the gear assembly utilizing such a spline configuration.

A signal maintainer conducting maintenance on a signal head 14 and signal lights 15 has available tools necessary to lower the mast 12, loosen or tighten the locking pins 40 and 41 on sector gears 31 and 32 of the signal head gear assembly 29. In addition, the signal maintainer may have available drive motors 36 and 37, the remote control 62 and electrical cables 63 to electrically connect the remote control 62 to the drive motors 36 and 37. In addition, the maintainer may require one or more electrical cables to electrically connect the remote control to a local power source as in a control house. If the wayside signal system 10 is remotely located with respect the control house, the remote control 62 may be powered by a portable power source such as battery pack.

In operation, the signal maintainer removes the clamp 17 from the housing 16 and activates the gear assembly 50 to lower the mast 12 to a substantially horizontal position. Once the maintainer lowers the mast 12 he/she attaches the drive motors 36 and 37 to the signal head gear assembly 29 and loosens the locking pins 40 and 41 on sector gears 31 and 32 of the gear assembly 29. The maintainer also connects the electrical cables 63 to the remote control 62 and drive motors 36 and 37, and then raises the mast 12 to the upright position. Using the remote control 62 the signal maintainer aligns the signal lights 15 as necessary so an operator of an approaching locomotive will be able to see the signal lights 15.

After the signal lights 15 are aligned, the mast 12 is lowered, and the locking pins 40 and 41 are tightened to secure the gear assembly 29 and signal head 14 in the correctly aligned position. The drive motors 36 and 37 are then removed from the gear assembly 29 and the apertures 64 and 65 in casing 38 are covered. If more than one signal head 14 is mounted on the mast 12, the above-described procedure is conducted for each signal head 14.

Figure 16:
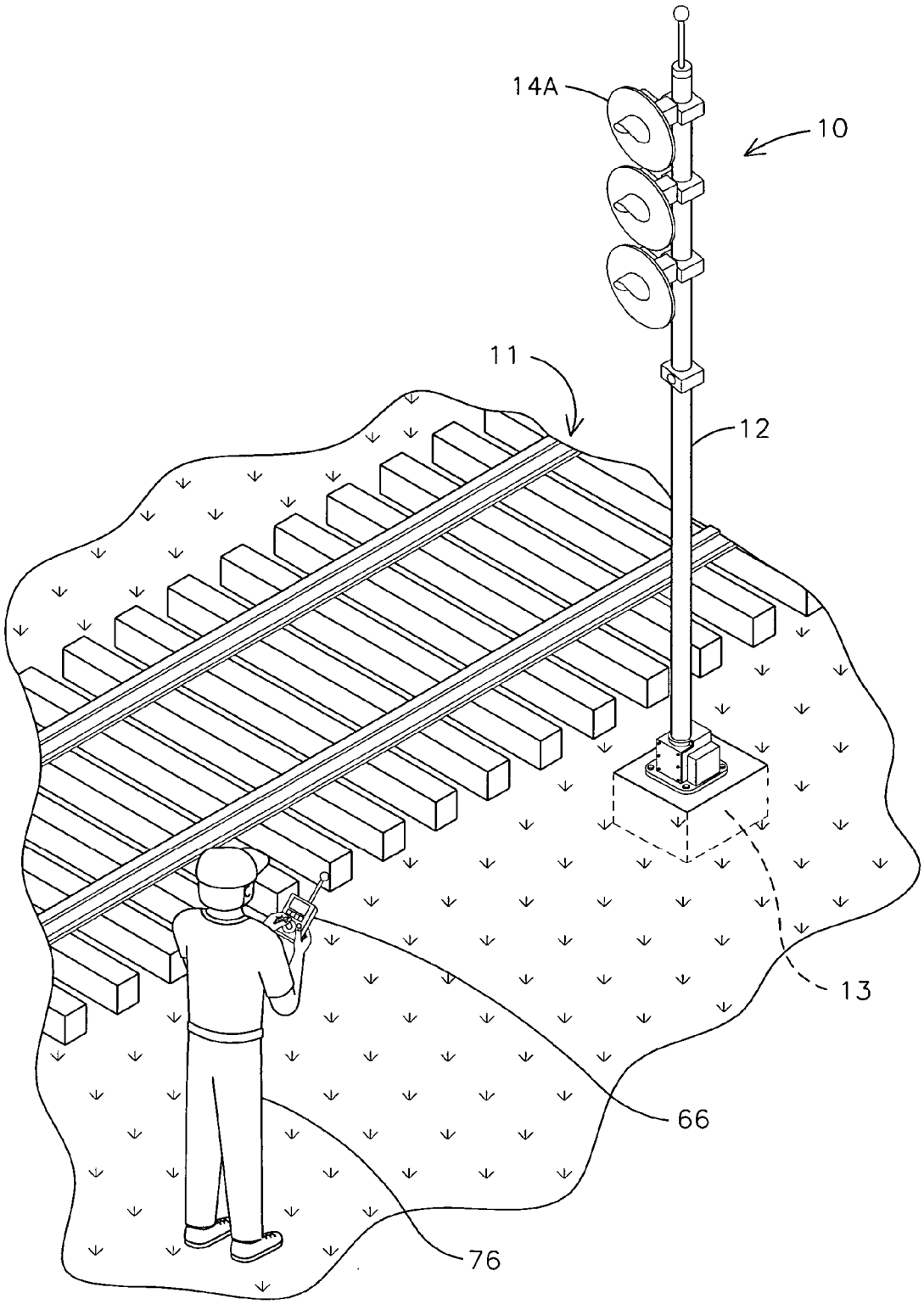
FIG. 16 is a view of a wireless embodiment of the invention.
Figure 17:
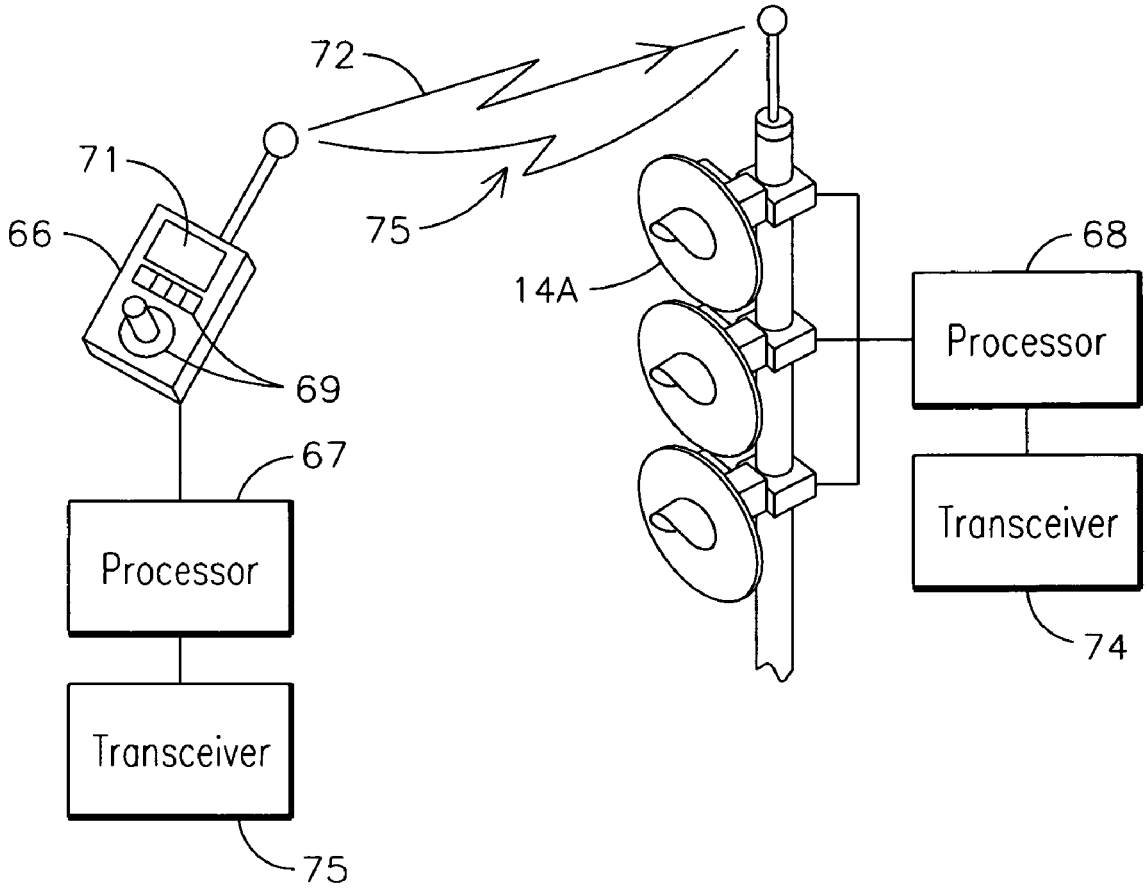
FIG. 17 is a schematic of a wireless embodiment of the invention

The schematic in FIGS. 16 and 17 illustrates a wayside signal system 10 incorporating a wireless communication system to move the signal heads 14. The drive motors 36 and 37 are preferably resident on the gear assembly 29 of the signal head 14, and not detached as described above. As such, locking pins 40 and 41 may be optionally used, as the drive motors 36 and 37 will lock the gear assembly 29 in place when the drive motors 36 and 37 are not operating. Power to the drive motors 36 and 37 may be supplied via the sets of electrical cables 46 and 47 referred to above that extend from a power source to the junction box 18 and up through the mast 12.

The wireless communication system may incorporate known technologies such as wireless area networks (WLAN) or wireless personal area networks (WPAN), Bluetooth technologies or the like, sufficient to transmit wireless signals a limited distance.

In an exemplary embodiment, the remote control unit 66 is equipped with a processor 67 that has a memory for storing data relating to the identification of a signal head 14 and the particular drive motor 36 or 37 to be activated, or the direction of movement of the signal head 14. It is known that wayside signal systems can be identified by location with respect to a railroad track, the direction in which a signal head faces and the vertical position of a signal head on a mast. For example, the location of the wayside system may be identified by the milepost number relative to the railroad track such as 101-milepost. A signal head may be facing north, south, east or west. This may be necessary as more than one wayside system may be positioned at the same milepost having signal heads facing in opposite directions.

For a wayside system having three signal heads on a mast 12, the position of the signal head 14 on the mast may be identified as top, middle or bottom signal head. The drive motors 36 and 37 on the signal head 14 are preferably identified in terms of the direction in which the drive motors actuate the signal head, i.e. vertical (up and down) movement and horizontal (side to side) movement. Accordingly, the processor 67 may be programmed to store data, for purposes of identifying a particular signal head and drive motor 36 or 37 on the signal head 14. The stored data preferably comprises data associated with the location of the wayside signal system 10 relative to the railroad track 11, the direction in which the signal head 14 is facing, the vertical position of the signal head on the mast 12 and the drive motor 36 or 37 on the signal head 14 (or the direction of movement of the signal head 14).

With respect to FIG. 17, a remote control unit 66 is illustrated having various input mechanisms 69 for inputting commands relative to the identification and movement of the signal head 14. The remote control unit 66 preferably has a display screen 71 that alphanumerically displays input commands or responses to signals received by the remote control unit 66. A keyboard, or other input mechanism such as voice-activated system, may be utilized to enter commands or codes that are representative of a particular signal head 14 and a drive motor 36 or 37.

Once a signal head 14 and drive motor 36 or 37 are selected a signal 72 can be generated from the remote control unit 66 to active the selected drive motor 36 or 37. Input mechanism 69, such as a joystick or touchpad, may be incorporated to input the command representative of the direction of movement of the joystick. Alternatively, the command that activates the drive motor 36 or 37 may be incorporated in the command that identifies the signal head 14 and drive motor 36 or 37. In such a case, the remote control unit 66 may have an input mechanism 69 associated with a command and signal to deactivate the drive motor 36 or 37. The processor 67 may access stored data that represents a predetermined distance the signal head 14 is to be moved so the drive motor 36 or 37 is automatically deactivated when the signal head 14 is moved the predetermined distance.

In an exemplary embodiment a second processor 68 and a receiver/transceiver 74 are positioned in communication with the drive motor 36 and 37. A single processor 68 and a single receiver/transceiver 74 may be used for all of the signal heads 14 and drive motors 36 and 37 on a mast 12, or each drive motor 36 and 37 may be equipped with a respective processor 68 and transceiver 74. The second processor 68 is programmed to translate signals 72 received from the remote control unit 66 for purposes of identifying signal head 14 to be moved and the drive motor 36 or 37 to be activated to move the signal head, and activation of the drive motor 36 or 37.

If the signal head 14 and drive motor 36 or 37 is equipped with a transceiver 74 signals 75 can be sent from the second processor 68 to the remote control unit 66, which may also have a transceiver 75. The second processor 68 may access a database or memory to generate signals representative of the status of a signal head 14 and drive motor 36 or 37. For example, the remote control unit 66 may generate an initial signal that is associated with the identification of the top signal head 14A facing west that needs to be moved vertically. The second processor 68 may generate a responsive signal indicating the initial signal has been received and the top signal head 14A and associated drive motor 36 or 37 have been identified for purposes of moving the signal head 14A. A maintainer 76 operating the remote control unit 66 may then enter a command to activate the drive motor 36 or 37 to move the signal head 14.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A railroad wayside signal system positioned on the ground adjacent to a railroad track, comprising:

a mast positioned adjacent to the railroad track in an upright position;

a support structure positioned adjacent to the railroad track, and the mast is pivotally mounted to the support structure between the upright position and a substantially horizontal position;

one or more railroad signal heads having one or more signal lights mounted on the signal head so the signal lights are within view of a locomotive operator and the signal head is moveable with respect to the mast;

one or more actuators operatively connected to the signal head to move the signal head in one or more directions with respect to the mast;

a remote control unit in communication with the actuators that generates a signal representative of one or more directions of movement of the signal head with respect to the mast.

2. The system of claim 1 comprising a first gear assembly supported within a housing that is mounted to the support structure and the first gear assembly is operatively connected to the mast, and is actuated to pivot the mast between the upright position and the substantially horizontal position.

3. The system of claim 2 further comprising a mounting block supported within a housing and operatively connected to the first gear assembly and the mast is affixed to the mounting block which pivots as the first gear assembly is actuated.

4. The system of claim 2 further comprising a tubular axle operatively connected to the first gear assembly and the tubular axle having a first end and a second end supported in the housing, and an opening in the tubular axle between the first end and the second end in communication with the mast and wherein one or more electrical cables, connected to a power source, extends through the first end or second end of the tubular axle, the opening in the tubular axle and through the mast to the signal lights on the signal head.

5. The system of claim 4 wherein a junction box is mounted to a side of the housing, and electrical terminals are mounted within an interior of the junction box, and the first end or second end of the tubular axle is in communication with the interior of the junction box and the electrical cables include a first set of electrical cables that are connected to a power source and the terminals, and a second set of electrical cables extend from the terminals to the signal lights.

6. The system of claim 2 wherein the housing has at least one side panel affixed to a base, which is affixed to the support structure, and a top panel affixed to a top of the one or more side panels and the housing covering the gear assembly, and an opening in a top of the housing through which the mast extends and a clamp is affixed to the top panel of the housing and supports the mast in the upright position.

7. The system of claim 6 wherein at least one side panel and top panel partially cover the gear assembly forming a gap through which the mast pivots and the clamp includes a panel that covers the gap in the housing, and the clamp is removable to lower the mast.

8. The system of claim 3 further comprising a mounting stub affixed to a top of the mounting block and the mast is secured to the mounting stub.

9. The system of claim 8 wherein the mast has an inside diameter that is greater than an outside diameter of the mounting stub, and the mast fits over the mounting stub and abuts a top of the mounting block and the mast is affixed to the mounting stub.

10. The system of claim 1 wherein the actuator comprises a second gear assembly mounted to the mast and operatively connected the signal head having one or more gears that operate to actuate the signal head along a vertical axis and one or more gears that operate to actuate the signal head along a horizontal axis in response to a signal from the remote control unit.

11. The system of claim 10 wherein the one or more actuators further comprises a first drive motor operatively connected to the second gear assembly, and activated from the remote control unit to actuate the second gear assembly which pivots the signal head along a horizontal axis, and a second drive motor activated from the remote control unit to actuate the second gear assembly to pivot the signal head along a vertical axis.

12. The system of claim 11 wherein the second gear assembly is supported within a housing mounted to the mast, and the housing having one or more apertures through which the first drive motor or second drive motor extend to engage the second gear assembly, and the first drive motor and second drive motor are detachable from the gear assembly.

13. The system of claim 10 wherein the one or more actuators comprises a first drive motor that engages the one or more gears of the second gear assembly that move the signal head along a vertical axis and a second drive motor that engages the one or more gears that move the signal head along a horizontal axis in response to a signal from the remote control unit, and the first drive motor and the second drive motor are detachable from the gear assembly after alignment of the signal using the remote control unit and drive motors.

14. A railroad wayside signal system positioned on the ground adjacent to a railroad track, comprising:

a mast positioned adjacent to the railroad track in a vertical upright operating position; and a support structure positioned adjacent to the railroad track, and the mast having a first end on which a signal head is mounted and a second end distal to the first end that is pivotally mounted to the support structure, wherein the signal head comprises one or more signal lights;

wherein a pivot location of the mast to the support structure is located proximate to the railroad track and/or to the ground or other support surface of the support structure, for selective pivoting movement of the mast between the upright position where the signal lights are within view of a locomotive operator and an inclined position or a substantially horizontal position of the mast where the signal head is located proximate the railroad track and/or the ground or other support surface of the support structure, for service access to the signal head.

15. The system of claim 14 comprising a first gear assembly supported within a housing that is mounted to the support structure and the first gear assembly is operatively connected to the mast, and is actuated to pivot the mast between the upright position and the substantially horizontal position.

16. The system of claim 15 further comprising a mounting block supported within a housing and operatively connected to the gear assembly and the mast is affixed to the mounting block, which pivots as the gear assembly is actuated.

17. The system of claim 15 further comprising a tubular axle operatively connected to the first gear assembly and the tubular axle having a first end and a second end supported in the housing, and an opening in the tubular axle between the first end and the second end in communication with the mast and wherein one or more electrical cables, connected to a power source, extends through the first end or second end of the tubular axle, the opening in the tubular axle and through the mast to the signal lights on the signal head.

18. The system of claim 17 wherein a junction box is mounted to a side of the housing, and electrical terminals are mounted within an interior of the junction box, and the first end or second end of the tubular axle is in communication with the interior of the junction box and the electrical cables include a first set of electrical cables that are connected to a power source and the terminals, and a second set of electrical cables extend from the terminals to the signal lights.

19. The system of claim 15 wherein the housing has at least one side panel affixed to a base, which is affixed to the support structure, and a top panel affixed to a top of the one or more side panels and the housing covering the gear assembly, and an opening in a top of the housing through which the mast extends and a clamp is affixed to the top panel of the housing and supports the mast in the upright position.

20. The system of claim 19 wherein at least one side panel and top panel partially cover the gear assembly forming a gap through which the mast pivots and the clamp includes a panel that covers the gap in the housing, and the clamp is removable to lower the mast.

21. The system of claim 20 further comprising a mounting stub affixed to a top of the mounting block and the mast is secured to the mounting stub.

22. The system of claim 21 wherein the mast has an inside diameter that is greater than an outside diameter of the mounting stub, and the mast fits over the mounting stub and abuts a top of the mounting block and the mast is affixed to the mounting stub.

23. A railroad wayside signal positioned on the ground adjacent to a railroad track, comprising:

a mast mounted on a support structure in an upright position, and the support structure and the mast are positioned adjacent to the railroad track;

one or more railroad signal heads having one or more signal lights mounted on the signal head so the signal lights are within view of a locomotive operator and the signal head is moveable with respect to the mast;

one or more actuators operatively connected to the signal head to move the signal head in at least two directions with respect to the mast;

a remote control unit in communication with the actuators that generates a signal representative of one or more directions of movement of the signal head with respect to the mast and the actuators move the signal head responsive to the signal.

24. The system of claim 23 wherein the one or more actuators comprises a gear assembly mounted to the mast and operatively connected the signal head having one or more gears that operate to actuate the signal head along a vertical axis and one or more gears that operate to actuate the signal head along a horizontal axis in response to a signal from the remote control unit.

25. The system of claim 24 wherein the one or more actuators further comprises a first drive motor operatively connected to the gear assembly, and activated from the remote control unit to actuate the gear assembly which pivots the signal ahead along a horizontal axis, and second drive motor activated from the remote control unit to actuate the gear assembly to pivot the signal head along a vertical axis.

26. The system of claim 24 wherein the gear assembly is supported within a housing mounted to the mast, and the housing having one or more apertures through which the first drive motor or second drive motor extend to engage the gear assembly, and the first drive motor and second drive motor are detachable from the gear assembly.

27. The system of claim 26 wherein the one or more actuators comprise a first drive motor that engages the one or more gears that move the signal head along a vertical axis and a second drive motor that engages the one or more gears that move the signal head along a horizontal axis in response to a signal from the remote control unit, and the first drive motor and second drive motor are detachable from the gear assembly after alignment of the signal using the remote control unit and drive motors.

28. The system of claim 25 wherein the remote control unit is connected to the first drive motor and the second drive motor by one or more electrical cables, and the remote control unit has one or more input mechanisms for inputting a command representative of a direction of movement of the signal head and the remote control unit generates a signal responsive to the command.

29. The system of the claim 25 wherein in the system has a wireless communication between the remote control unit and the first drive motor and the second drive motor.

30. The system of claim 29 wherein the remote control unit has a processor having a memory with stored data that is representative of a location of the signal head relative to the railroad track and a direction of movement of the signal head.

31. The system of claim 30 wherein the remote control unit has a transmitter for transmitting a signal representative of the location of the signal head relative to the railroad track and a direction of movement of the signal head vertically or horizontally, and the wireless system also having a processor and a receiver in communication with the first drive motor and second drive motor and the processor translates the signal from the remote control unit.

32. The system of claim 30 wherein the wayside system has a plurality of signal heads and the stored data is representative a position of a signal head on the mast relative to the other signal heads on the mast.

33. The system of claim 30 wherein the stored data is reprehensive of an identification of the first drive motor relative to the second drive motor.

34. A railroad wayside signal system positioned on the ground adjacent to a railroad track, comprising:

a mast positioned adjacent to the railroad track in an upright position;

a support structure positioned adjacent to the railroad track, and the mast is pivotally mounted to the support structure between the upright position and a substantially horizontal position;

one or more railroad signal heads having one or more signal lights mounted on the signal head so the signal lights are within view of a locomotive operator and the signal head is moveable with respect to the mast;

one or more actuators operatively connected to the signal head to move the signal head in one or more directions with respect to the mast;

a remote control unit having a processor and a memory with stored data representative of one or more directions of movement of the signal head and the remote control having an input mechanism for inputting a command associated with a direction of movement of the signal head and a transmitter for transmitting a signal representative of the direction of movement of the signal head in response to the input command; and, a transceiver interfaced with the one or more actuators for receiving the signal from the transmitter and interpreting the signal then transmitting the signal.

35. The system of claim 14 wherein the mast is an elongated member vertically disposed in an operation mode having a first distal end pivotally connected to the support structure and a second distal end to which the signal head is attached, wherein the mast pivots relative to support structure between the vertical operational position to an inclined or horizontal position wherein the signal head is positioned proximate the ground for service access.

* * * * *